US010967499B2

(12) United States Patent
Yogev et al.

(10) Patent No.: US 10,967,499 B2
(45) Date of Patent: Apr. 6, 2021

(54) TILT BIN FOR USE IN A TILT BIN STORAGE SYSTEM

(71) Applicant: Huliot Storage Solutions Ltd., Upper Galilee (IL)

(72) Inventors: Ilan Yogev, Upper Gallilee (IL); Ronen Peleg, Upper Gallilee (IL)

(73) Assignee: Huliot Storage Solutions Ltd., Upper Galilee (IL)

( * ) Notice: Subject to any disclaimer, the term of this patent is extended or adjusted under 35 U.S.C. 154(b) by 109 days.

(21) Appl. No.: 16/094,771

(22) PCT Filed: Apr. 13, 2017

(86) PCT No.: PCT/IL2017/050449

§ 371 (c)(1),
(2) Date: Oct. 18, 2018

(87) PCT Pub. No.: WO2017/183025

PCT Pub. Date: Oct. 26, 2017

(65) Prior Publication Data

US 2020/0061801 A1 Feb. 27, 2020

(30) Foreign Application Priority Data

Apr. 20, 2016 (IL) ..... 245210

(51) Int. Cl.
*B25H 3/00* (2006.01)
*B25H 3/02* (2006.01)
(Continued)

(52) U.S. Cl.
CPC ..... *B25H 3/021* (2013.01); *A47B 88/60* (2017.01); *A47B 95/02* (2013.01); *A47B 2095/024* (2013.01)

(58) Field of Classification Search
CPC ... Y10T 16/469; Y10T 16/459; Y10T 16/462; A47B 95/02; A47B 2095/023;
(Continued)

(56) References Cited

U.S. PATENT DOCUMENTS 1,247,033 A * 11/1917 Swartz ..... A47B 23/042 248/459
2,469,893 A * 5/1949 Rockwell ..... E05C 19/063 292/76
(Continued)

FOREIGN PATENT DOCUMENTS

DE 392101 C 3/1924
DE 9317217 * 1/1994
(Continued)

OTHER PUBLICATIONS

International Search Report issued for PCT/IL2017/050449 (WO2017/183025 A3), dated Oct. 27, 2017.
(Continued)

*Primary Examiner* — Janet M Wilkens
(74) *Attorney, Agent, or Firm* — Novick, Kim & Lee, PLLC; Harold L. Novick

(57) ABSTRACT

Tilt bin storage systems including a discrete multi-storey open front tilt bin frame having a single rectangular front frame surface and at least a lowermost storey of tilt bins and an uppermost storey of tilt bins. The tilt bins include a tilt bin shell, a discrete tilt bin handles and a securing arrangement for securing a discrete tilt bin handle on the tilt bin shell on downward sliding of the discrete tilt bin handle on a tilt bin shell front surface.

2 Claims, 9 Drawing Sheets

(51) Int. Cl.
*A47B 88/60* (2017.01)
*A47B 95/02* (2006.01)

(58) Field of Classification Search
CPC ..... A47B 2095/024; A47B 2095/025; A47B 88/60; A47B 88/95; A47B 88/931; A47B 2088/902; A47B 2088/941; A47B 2088/944; A47B 2088/95; A47B 2088/951; A47B 2088/953; A47B 2088/954; A47B 2088/955; A47B 2088/956; B25H 3/021; F16B 12/14; F16B 12/24; F16B 12/46
USPC ..... 16/413, 415, 422; 312/348.6, 244, 328, 312/327, 902, 330.1, 334.6, 348.1–348.4; 280/47.19
See application file for complete search history.

(56) References Cited

U.S. PATENT DOCUMENTS

| | | | | |
|---|---|---|---|---|
| 2,805,911 | A * | 9/1957 | Anderson | A47B 95/02 312/348.6 |
| 3,107,389 | A | 10/1963 | Engelbrecht | |
| 4,096,603 | A * | 6/1978 | Klaus | A47B 95/02 16/416 |
| 4,108,519 | A | 8/1978 | Chervenak | |
| 4,155,611 | A | 5/1979 | Brekke et al. | |
| 4,379,603 | A * | 4/1983 | Johnson | A47B 95/02 16/415 |
| 4,573,751 | A | 3/1986 | Swank | |
| 5,074,009 | A | 12/1991 | Simonton et al. | |
| D365,229 | S | 12/1995 | Story et al. | |
| D424,356 | S | 5/2000 | Hahn | |
| D424,807 | S | 5/2000 | Dembicks | |
| 6,267,260 | B1 * | 7/2001 | Lyons | B65F 1/1426 16/110.1 |
| D522,742 | S | 6/2006 | Priebe | |
| 7,798,486 | B2 * | 9/2010 | Hasegawa | G03G 15/6502 16/406 |
| D635,364 | S | 4/2011 | Benetti | |
| D680,333 | S | 4/2013 | Edwards | |
| D696,007 | S | 12/2013 | Priebe et al. | |
| 8,714,372 | B2 | 5/2014 | Yogev | |
| D720,134 | S | 12/2014 | Baruch | |
| D757,437 | S | 5/2016 | Hegarty | |
| D773,189 | S | 12/2016 | Reinhart | |
| D777,430 | S | 1/2017 | Thomas | |
| D785,379 | S | 5/2017 | Maffett et al. | |
| D789,088 | S | 6/2017 | Stuart et al. | |
| D814,193 | S | 4/2018 | Peleg et al. | |
| D830,061 | S | 10/2018 | Peleg et al. | |
| 2003/0088945 | A1 * | 5/2003 | Baum | A47G 23/0216 16/422 |
| 2003/0233733 | A1 * | 12/2003 | Parker | A47B 95/02 16/415 |
| 2007/0235397 | A1 | 10/2007 | Wannop | |
| 2009/0106942 | A1 * | 4/2009 | Dell'Orfano | A47B 95/02 16/425 |
| 2010/0044270 | A1 | 2/2010 | Noble et al. | |
| 2010/0146738 | A1 * | 6/2010 | Kunnath | E05B 1/0015 16/415 |
| 2013/0168341 | A1 | 7/2013 | Yogev | |
| 2014/0033498 | A1 | 2/2014 | Coffin et al. | |

FOREIGN PATENT DOCUMENTS

| | | | |
|---|---|---|---|
| EP | 0162232 | A2 | 11/1985 |
| GB | 1117781 | A | 6/1968 |
| WO | 2005021221 | * | 3/2005 |

OTHER PUBLICATIONS

Menards, Tilt Bin Organizers (3-Pack), Model No. 669, Menards SKU 2452514 (available online at https://www.menards.com/main/p-1444423414335.htm, accessed on Feb. 17, 2017).
ULINE, "Tip-Out Bins", Accessed Apr. 11, 2018, (https://www.uline.com/BL_1432/Tip-Out-Bins).
Amazon, "Deflecto 20604OPU Six-bin horizontal tilt bin storage system", First for sale Apr. 18, 2006. (https://www.amazon.com/Deflecto-20604OPU-Six-bin-horizontal-storage/dp/B000J0C8TM).

* cited by examiner

TILT BIN FOR USE IN A TILT BIN STORAGE SYSTEM

FIELD OF THE INVENTION

The invention relates to tilt bin storage systems.

BACKGROUND OF THE INVENTION

Commercially available tilt bin storage systems range from a discrete single storey open front tilt bin frame of two or more side-by-side tilt bin compartments for individually snugly accommodating open-topped tilt bins to complete storage systems including wall high rows of side-by-side open topped tilt bins. Open topped tilt bins have a generally cuboid shape tilt bin shell and an integral tilt bin handle protruding from a tilt bin shell front surface for enabling a convenient pivot action from an upright closed position to a tilted forward open position for providing user access to its interior. Open-topped tilt bins are typically formed from clear transparent plastic material such that a user can readily view their contents. Tilt bin storage systems are preferably transported with the discrete tilt bin frames pre-fitted with tilt bins to economize on transportation and storage costs. But the forward protruding integral tilt bin handles are prone to damage and breakage during transportation and storage. U.S. Design Patent No. 680,333 to Edwards shows a tilt bin front cover for snap fit on a tilt bin front surface.

One particular commercially successful tilt bin storage system is a so-called 669 tilt bin storage system including two discrete single storey tilt bin frames each having six tilt bins and a discrete single storey tilt frame having nine tilt bins. The three discrete single storey tilt bin frames are intended to be neatly stacked as a cubby hole structure either directly wall mounted or preferably wall mounted by means of a kit for assembling a rigid support structure as disclosed in commonly owned U.S. Pat. No. 8,714,372 to Yogev. Directly wall mounting three discrete single storey tilt bin frames is a time consuming task and requires considerable skill to ensure they are neatly stacked.

Such stacking necessarily requires the three discrete single storey tilt bin frames to have the same width and consequently the width of the side-by-side tilt bin compartments of the discrete single storey tilt bin frame with nine tilt bin compartments is narrower than the width of the side-by-side tilt bin compartments of the two discrete single storey tilt bin frames with six tilt bin compartments. As a further consequence, since the tilt bins are generally cuboid and tilt bin compartments snugly accommodate same, the height and depth of the side-by-side tilt bin compartments of the discrete single storey tilt bin frame with nine tilt bin compartments are smaller than the corresponding dimensions of the side-by-side tilt bin compartments of the two discrete single storey tilt bin frames with six tilt bin compartments. Accordingly, users typically wall mount a 669 tilt bin storage system with the tilt bin frame with nine tilt bins on top of the tilt bin frames each with six tilt bins which leads to the uppermost tilt bin frame with nine tilt bins being set back with respect to the tilt bin frames with six tilt bins thereby inconveniencing user access to the nine tilt bins.

SUMMARY OF THE INVENTION

The first aspect of the present invention is directed towards a tilt bin storage system including a discrete multi-storey open front tilt bin frame having a single rectangular front frame surface and at least a lowermost storey of tilt bins and an uppermost storey of tilt bins. The tilt bins are generally cuboid. The lowermost storey tilt bins are larger than the uppermost storey tilt bins and therefore the lowermost storey of tilt bins includes fewer tilt bins than the uppermost storey of tilt bins. The discrete multi-storey open front tilt bin frames are designed such that all tilt bins irrespective of the storey in which they are located are flush with their single rectangular front frame surfaces in their upright closed positions. Accordingly, the tilt bin front surfaces of all the tilt bins are co-planar, thereby facilitating user access to the uppermost storey tilt bins. Moreover, the discrete multi-storey open front tilt bin frame has a more aesthetic streamlined appearance than a stack of three discrete single storey open front tilt bin frames. Tilt bin storage systems of the first aspect of the present invention can be equally fitted with conventional tilt bins or tilt bins in accordance with the second aspect of the present invention.

The discrete multi-storey open front tilt bin frames preferably employ space rearward of their uppermost storey of uppermost storey tilt bins for additional storage purposes. This is preferably achieved by the discrete multi-storey open front tilt bin frames having rectangular opposite frame left side surface and frame right side surface to bound an open-topped compartment on wall mounting the discrete multi-storey open front tilt bin frame. The compartment can be sub-divided into smaller compartments, for example, for snugly receiving storage units with upright storage bores intended to snugly hold drill bits, screw drivers, and the like.

The second aspect of the present invention is directed towards a tilt bin for use in a tilt bin storage system. The tilt bin includes an open-topped tilt bin shell having a tilt bin shell front surface, a tilt bin shell back surface, a tilt bin shell bottom surface, a tilt bin shell left side surface and a tilt bin shell right side surface. The tilt bin includes a discrete tilt bin handle for user mounting on a tilt bin shell front surface subsequent to purchase of a tilt bin storage system. The user mounting includes downward sliding a discrete tilt bin handle on a tilt bin shell front surface in the direction of a tilt bin shell bottom surface. Tilt bins can be formed with different tilt bin handle mounting arrangements some preventing and some enabling replacement of a discrete tilt bin handle. Tilt bin handles can be provided in different colors such that a user can color code tilt bins for assisting in visual identification of their contents.

Provision of discrete tilt bin handles as opposed to integral tilt bin handles ensures that they are not damaged during transportation or storage. Moreover, the unit transportation and storage costs of open front tilt bin frames pre-fitted with tilt bins without forward protruding integral tilt bin handles is necessarily less than with forward protruding integral tilt bin handles. The tilt bins can be fitted in conventional discrete single storey open front tilt bin frames or discrete multi-storey open front tilt bin frames in accordance with the first aspect of the present invention.

BRIEF DESCRIPTION OF DRAWINGS

In order to understand the invention and to see how it can be carried out in practice, preferred embodiments will now be described, by way of non-limiting examples only, with reference to the accompanying drawings in which similar parts are likewise numbered, and in which.

DETAILED DESCRIPTION OF DRAWINGS

Figure 1:
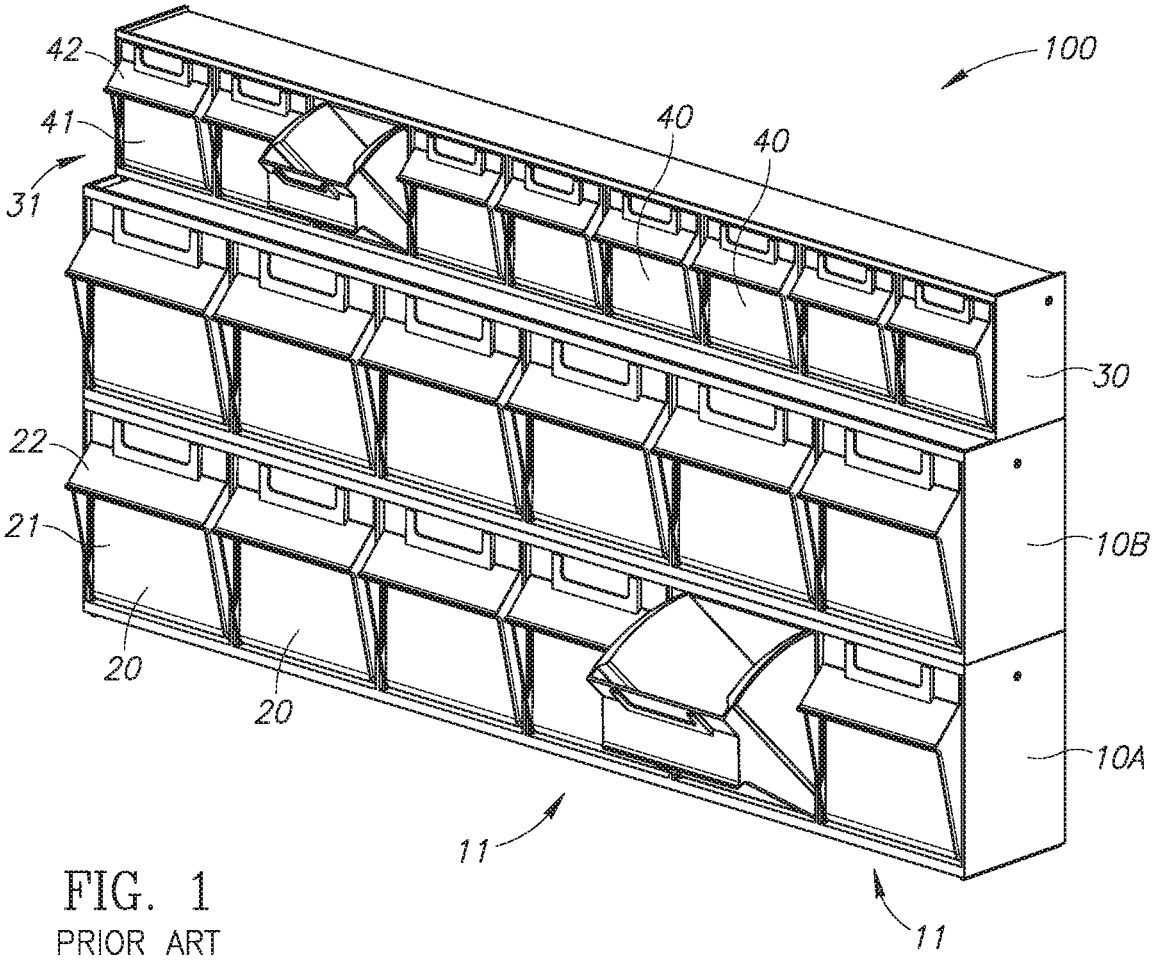
FIG. 1 PRIOR ART
FIG. 1 shows a front perspective view of a conventional wall mounted 669 tilt bin storage system.
Figure 2:
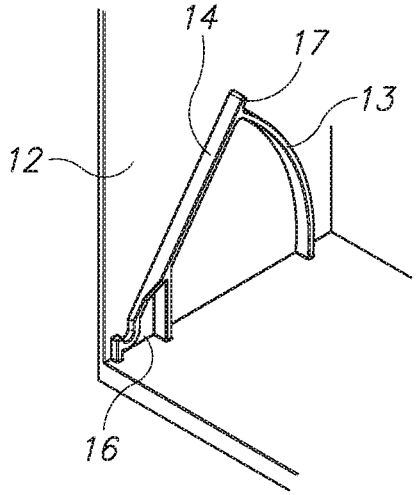
FIG. 2 PRIOR ART
FIG. 2 shows a side wall of a tilt bin compartment of FIG. 1's 669 tilt bin storage system.

FIG. 1 shows a conventional wall mounted 669 tilt bin storage system 100 including a stack of two identical discrete single storey open front tilt bin frames 10A and 10B each having six tilt bin compartments 11 for accommodating tilt bins 20 and an uppermost discrete single storey open front tilt bin frame 30 with nine tilt bin compartments 31 for accommodating tilt bins 40. The tilt bins 20 have an open-topped generally cuboid shaped tilt bin shell 21 with a forward protruding integral tilt bin handle 22 intended for enabling a user to conveniently pivot a tilt bin 20 in a tilt bin compartment 11 between an upright closed position and a tilted forward open position. The tilt bins 40 have an open-topped generally cuboid shaped tilt bin shell 41 with a forward protruding integral tilt bin handle 42 intended for enabling a user to conveniently pivot a tilt bin 40 in a tilt bin compartment 31 between an upright closed position and a tilted forward open position. The tilt bin frame 30 is set back with respect to the two tilt bin frames 10 thereby inconveniencing user access to the tilt bins 40.

The tilt bin compartments 11 and 31 have the same construction for enabling a pivot action of a tilt bin between an upright closed position and a tilted forward open position but differ insofar as the tilt bin compartment 11 is larger than the tilt bin compartment 31. The tilt bin compartments 11 are intended to snugly accommodate a tilt bin 20 having a width W1 and a depth D1 and the tilt bin compartments 31 are intended to snugly accommodate a tilt bin 40 having a width W2 and a depth D2 wherein W1>W2 and D1>D2. The tilt bin compartments 11 and 31 have a pair of opposite side walls 12 each having an arc shaped guide rail 13 and an inclined strut 14. The inclined strut 14 includes a leading recess 16. The inclined strut 14 meets the arc shaped guide rail 13 and extends therebeyond to form a stop 17.

Figure 3:
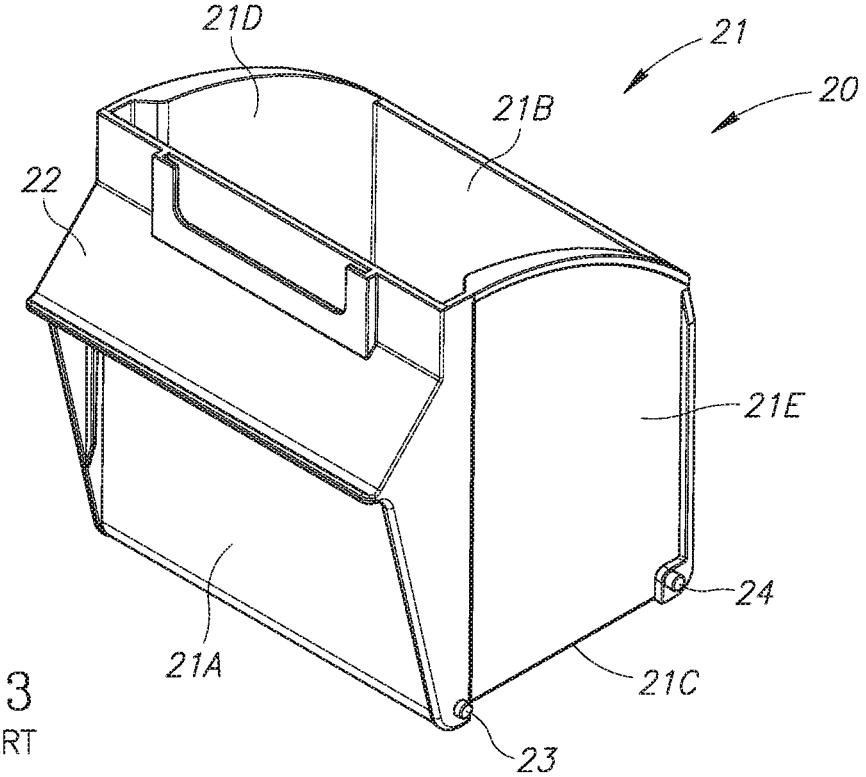
FIG. 3 PRIOR ART
FIG. 3 shows a front perspective view of a tilt bin of a discrete single storey open front tilt bin frame with six tilt bins including a forward protruding integral tilt bin handle.

FIG. 3 shows a tilt bin shell 21 has a tilt bin shell front surface 21A with the forward protruding integral tilt bin handle 22, a tilt bin shell back surface 21B, a tilt bin shell bottom surface 21C, a tilt bin shell left side surface 21D and a tilt bin shell right side surface 21E. The tilt bin side surfaces 21D and 21E are formed with two features for engaging complementary features formed on opposite side walls 12 of a tilt bin compartment 11 for enabling pivot action between an upright closed position and a tilted forward open position as follows: First, leading opposite outward directed sideway protrusions 23 for insertion in the recesses 16. And second, trailing opposite outward directed sideway stoppers 24 for sliding along the arc shaped guide rails 13 and stopping against the stops 17 in the tilted forward open position.

Figure 4:
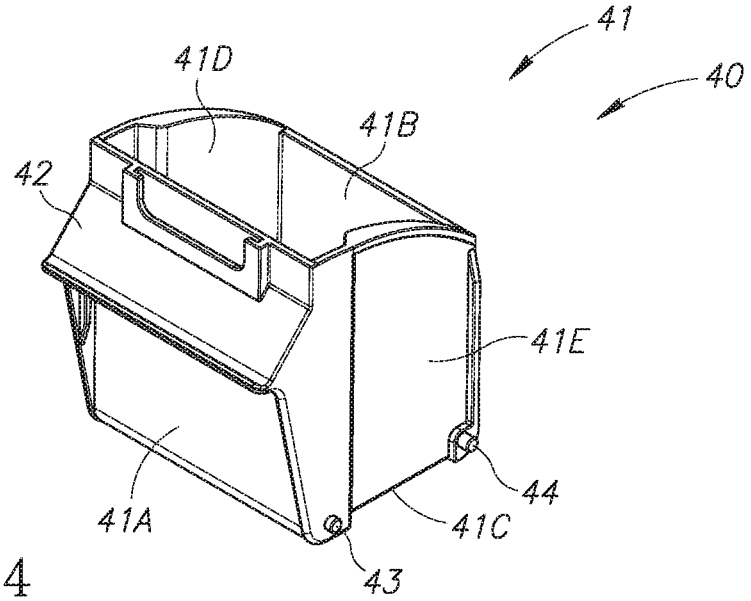
FIG. 4 PRIOR ART
FIG. 4 shows a front perspective view of a tilt bin of a discrete single storey open front tilt bin frame with nine tilt bins including a forward protruding integral tilt bin handle.

FIG. 4 shows a tilt bin shell 41 has a tilt bin shell front surface 41A with the forward protruding integral tilt bin handle 42, a tilt bin shell back surface 41B, a tilt bin shell bottom surface 41C, a tilt bin shell left side surface 41D and a tilt bin shell right side surface 41E. The tilt bin side surfaces 41D and 41E are formed with two features for engaging complementary features formed on opposite side walls 12 of a tilt bin compartment 31 for enabling pivot action between an upright closed position and a tilted forward open position as follows: First, leading opposite outward directed sideway protrusions 43 for insertion in the recesses 16. And second, trailing opposite outward directed sideway stoppers 44 for sliding along the arc shaped guide rails 13 and stopping against the stops 17 in the tilted forward open position.

Figure 5:
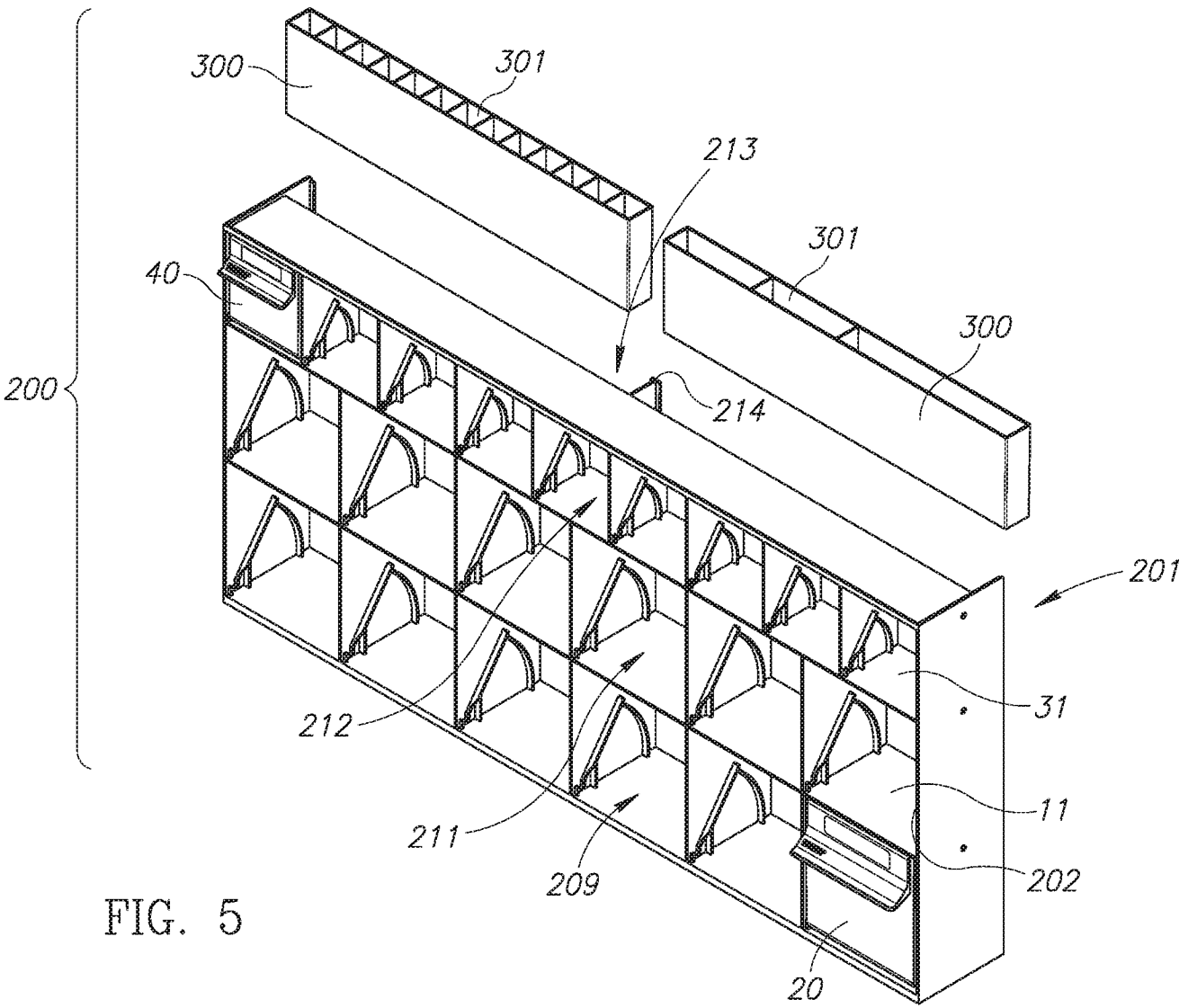
FIG. 5 shows a front perspective view of a first embodiment of a 669 tilt bin storage system including a discrete triple storey open front tilt bin frame in accordance with a first aspect of the present invention.
Figure 6:
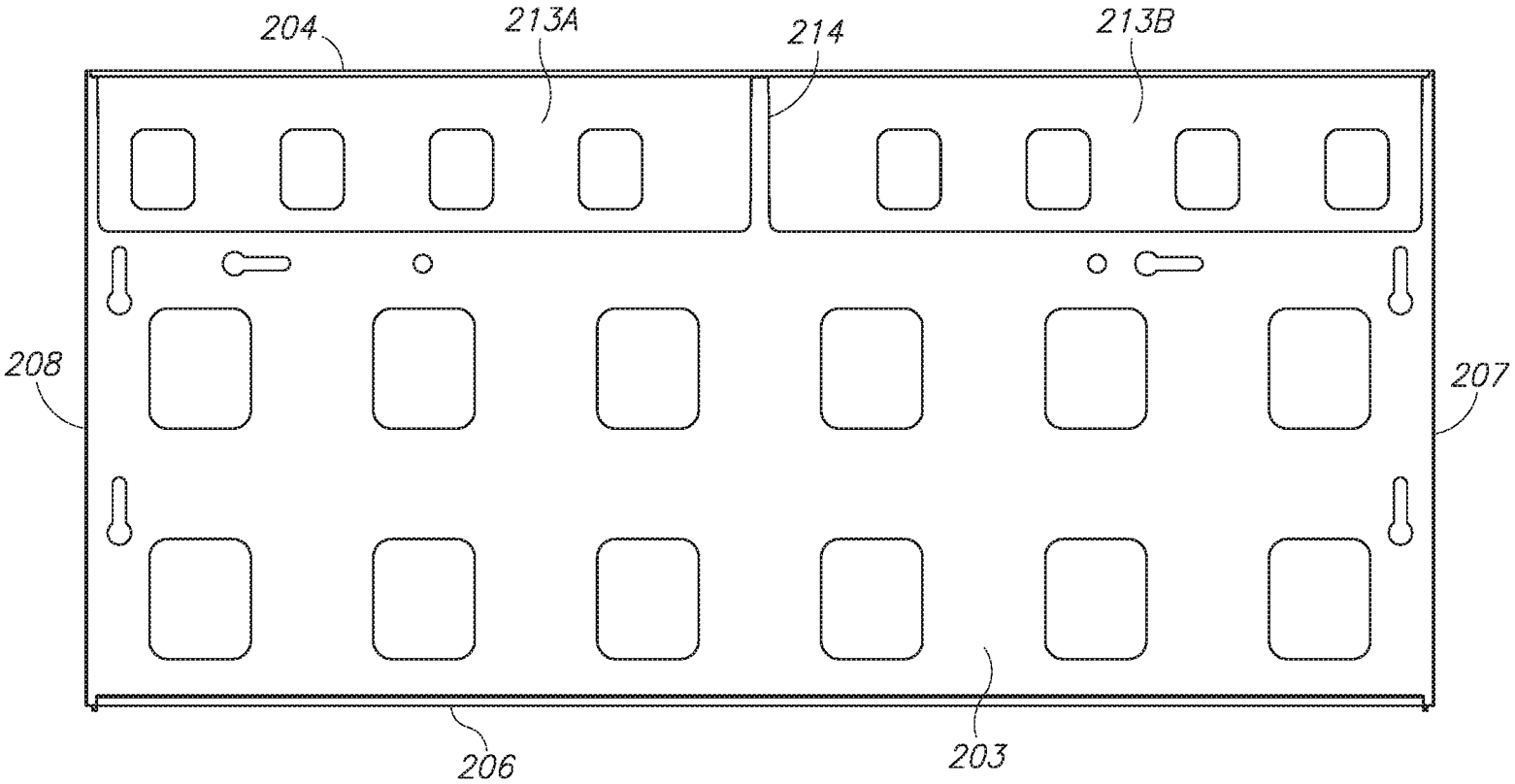
FIG. 6 shows a rear elevation view of FIG. 5's discrete triple storey open front tilt bin frame.

FIG. 5 and FIG. 6 show a 669 tilt bin storage system 200 including a generally rectangular parallelepiped discrete triple-storey open front tilt bin frame 201, twelve tilt bins 20 and nine tilt bins 40, and two discrete storage units 300. The tilt bin frame 201 includes a single rectangular frame front surround 202, a frame back surface 203, a frame top surface 204, a frame bottom surface 206, a frame left side surface 207, and a frame right side surface 208. The tilt bin frame 201 includes a lowermost storey of six tilt bin compartments 209 including six tilt bin compartments 11 for accommodating six tilt bins 20, a middle storey of six tilt bin compartments 211 including six tilt bin compartments 11 for accommodating six tilt bins 20 and an uppermost storey of nine tilt bin compartments 212 including nine tilt bin compartments 31 for accommodating nine tilt bins 40. The 669 tilt bin storage system 200's uppermost storey of nine tilt bin compartments 212 is disposed forward with respect to the conventional 669 tilt bin storage system 100's uppermost discrete single storey open front tilt bin frame 30 such that the discrete triple-storey open front tilt bin frame 201 has the single rectangular frame front surround 202. Accordingly, on snug accommodation of the tilt bins 20 and the tilt bins 40 therein in their upright closed positions, their respective tilt bin shell front surfaces 21A and tilt bin shell front surfaces 41A are co-planar and flush with the single rectangular frame front surround 202 for facilitating user access to the tilt bins 40 in contradistinction with the tilt bin storage system 100's tilt bins 40.

The frame left side surface 207 and the frame right side surface 208 are preferably rectangular such that the discrete triple-storey open front tilt bin frame 201 bounds an open-topped compartment 213 rearward of the uppermost storey of tilt bin compartments 212 on wall mounting the tilt bin storage system 200 for additional storage space. The discrete triple-storey open front tilt bin frame 201 preferably includes a central partition 214 for dividing the compartment 213 into two compartments 213A and 213B for slidingly receiving the storage units 300. The storage units 300 can include upright storage bores 301 intended to snugly hold drill bits, screw drivers, and the like.

Figure 7:
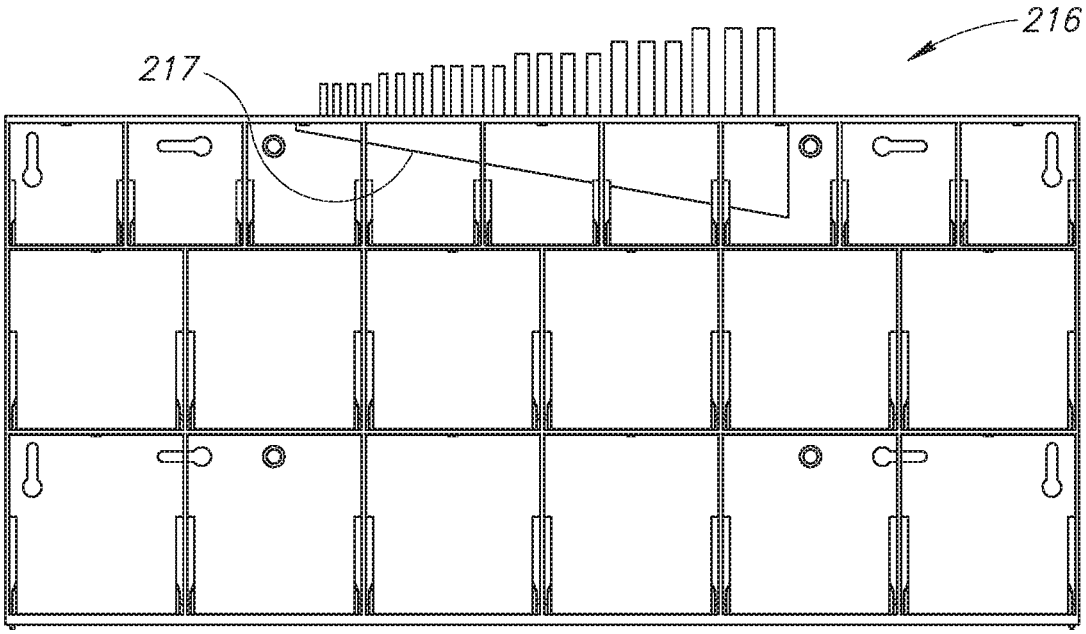
FIG. 7 shows a front elevation view of a second embodiment of a discrete triple storey open front tilt bin frame in accordance with the first aspect of the present invention.
Figure 8:
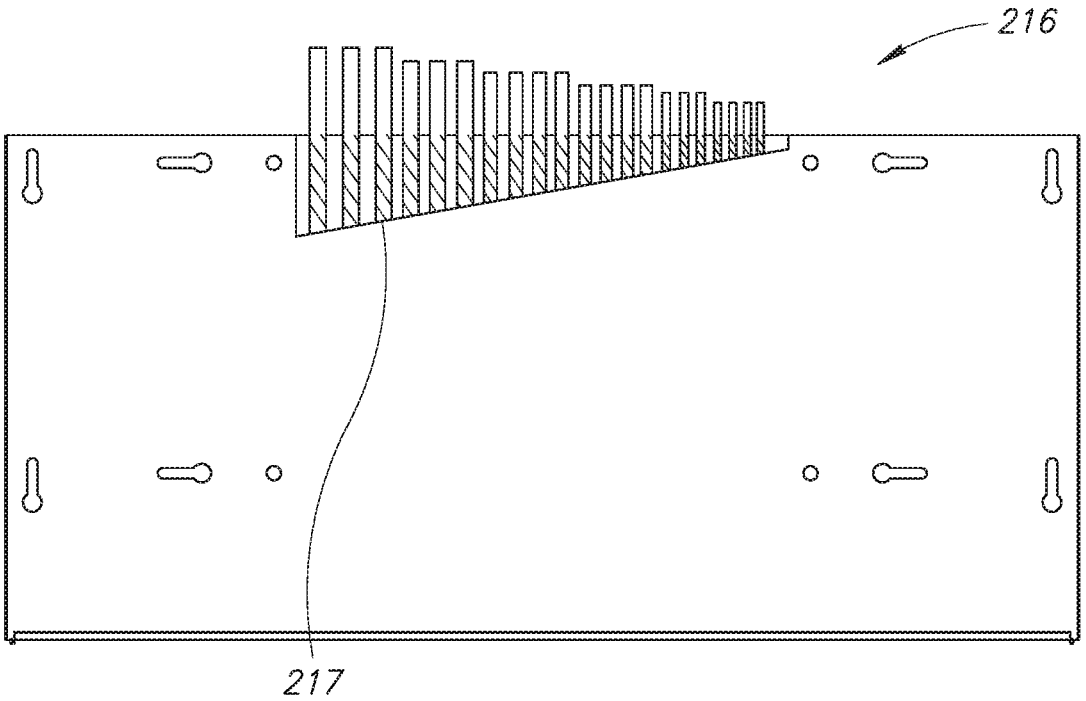
FIG. 8 shows a rear elevation view of FIG. 7's discrete triple storey open front tilt bin frame.

FIG. 7 and FIG. 8 show a discrete triple storey open front tilt bin frame 216 similar in construction to the discrete triple storey open front tilt bin frame 201 and therefore similar parts are likewise numbered. The tilt bin frame 216 differs from the tilt bin frame 201 insofar as it include an integral storage unit 217 rearward of the uppermost storey of uppermost storey tilt bin compartments 212 similar to the discrete storage units 300. The storage unit 217 is depicted storing a range of different sized drill bits.

Figure 9A:
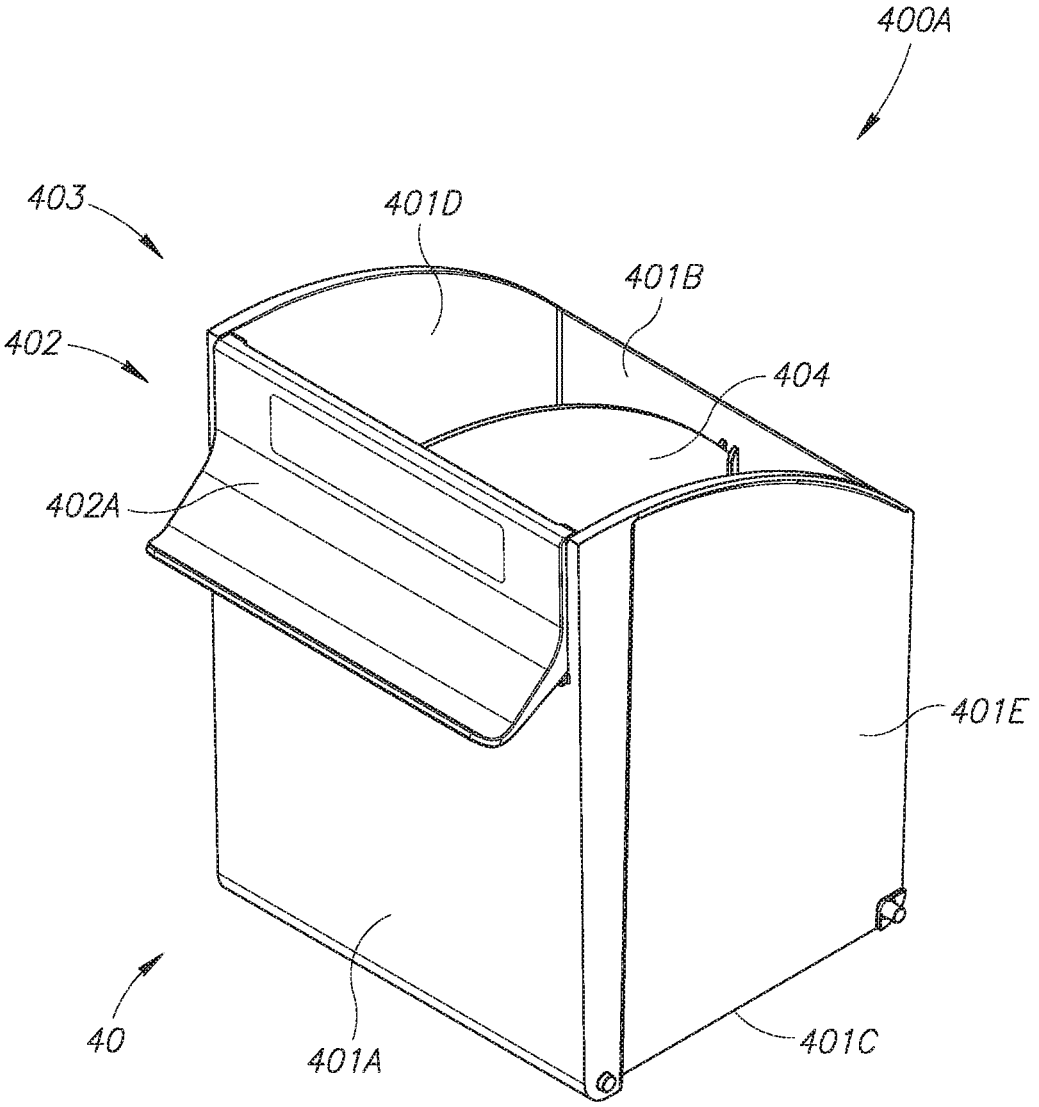
FIG. 9A is a front perspective view of a first embodiment of an assembled tilt bin with a discrete tilt bin handle in accordance with a second aspect of the present invention.
Figure 9B:
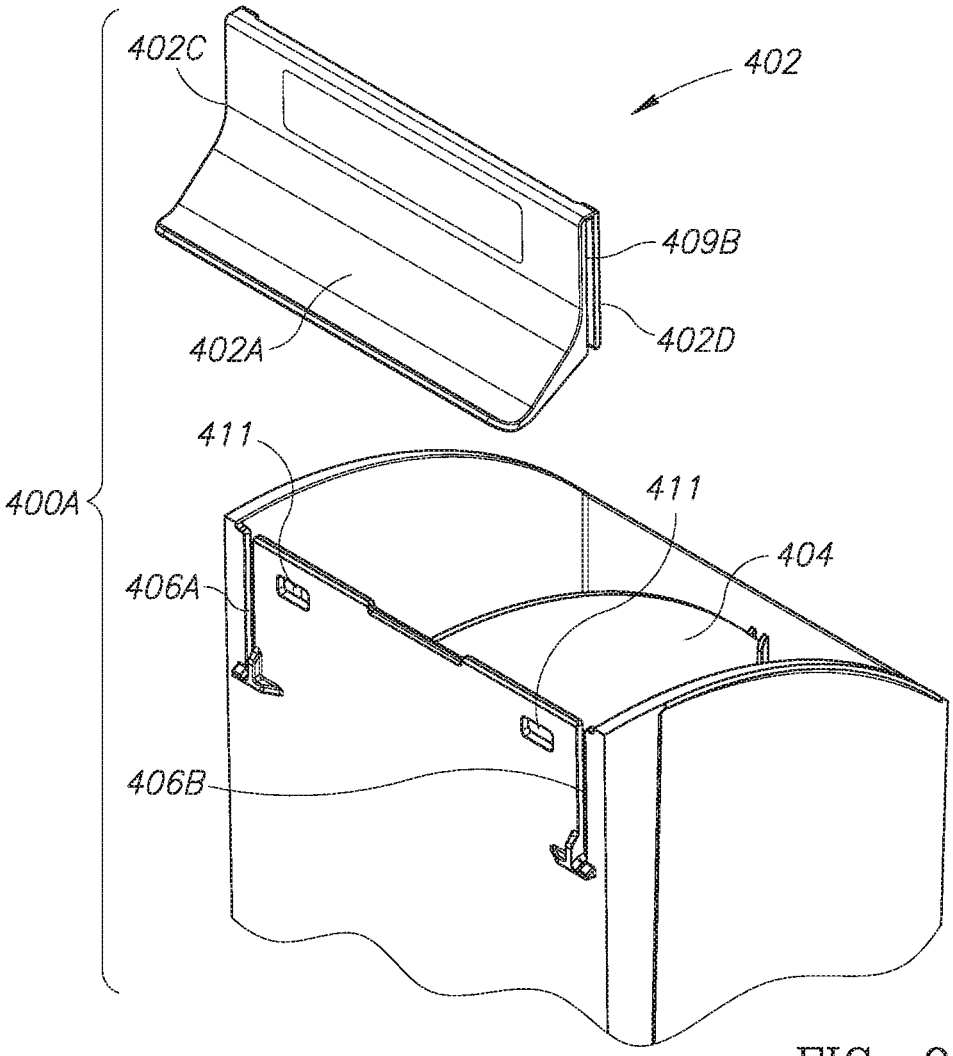
FIG. 9B is an exploded front perspective view of FIG. 9A's tilt bin.
Figure 9C:
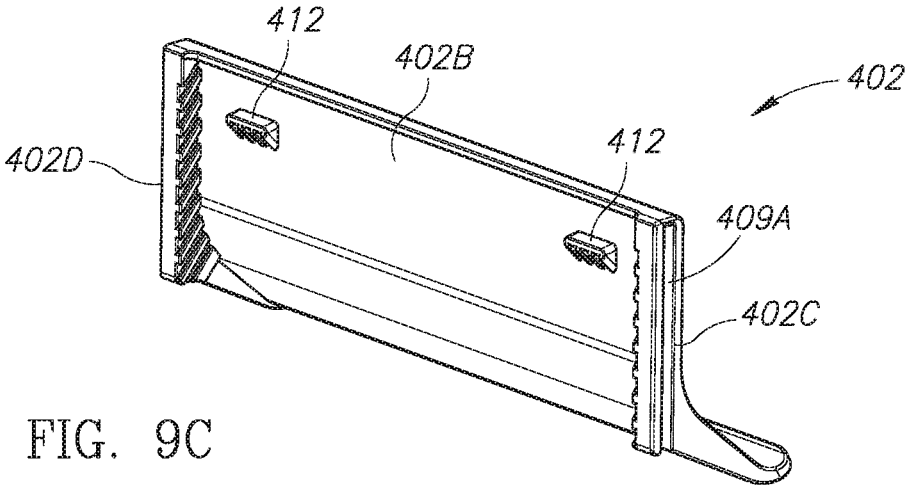
FIG. 9C is a rear perspective view of FIG. 9A's discrete tilt bin handle.

FIG. 9A to FIG. 9C show an assembled tilt bin 400A including an open topped generally cuboid tilt bin shell 401, a discrete tilt bin handle 402 for mounting on the tilt bin shell 401 and a securing arrangement 403 for securely mounting the discrete tilt bin handle 402 on the tilt bin shell 401. The tilt bin shell 401 includes a tilt bin shell front surface 401A, a tilt bin shell back surface 401B, a tilt bin shell bottom surface 401C, a tilt bin shell left side surface 401D and a tilt bin shell right side surface 401E. The tilt bin handle 402 has a tilt bin handle front surface 402A, a tilt bin handle back surface 402B, a tilt bin handle left side surface 402C and a tilt bin handle right side surface 402D. The tilt bin 400A is formed with conventional features on their side surfaces 401D and 401E for enabling pivot action between an upright closed position and a tilted forward open position such that the tilt bins 400 can be equally fitted in a conventional 669 tilt bin storage system 100 and a tilt bin storage system 200. The tilt bin 400A includes a central partition 404 for dividing the storage space into two halves.

The tilt bin shell front surface 401A has a spaced apart upright lateral pair of a left side slit 406A and a right side slit 406B correspondingly adjacent the tilt bin shell left side surface 401D and the tilt bin shell right side surface 401E for bounding a central major tilt bin shell front surface section 407 and a lateral pair of minor tilt bin shell front surface sections 408A and 408B. The tilt bin handle left side surface 402C and the tilt bin handle right side surface 402D are correspondingly formed with upright grooves 409A and 409B for sliding receiving the lateral pair of minor tilt bin shell front surface sections 408A and 408B on downward sliding of the discrete tilt bin handle 402 on the tilt bin shell front surface 401A in the direction of the tilt bin shell bottom surface 401C.

The securing arrangement 403 is constituted by the central major tilt bin shell front surface section 407 being formed with a lateral pair of spaced apart slots 411 and the tilt bin handle back surface 402B being formed with a corresponding lateral pair of spaced apart protrusions 412 for snap fit thereinto.

Figure 10A:
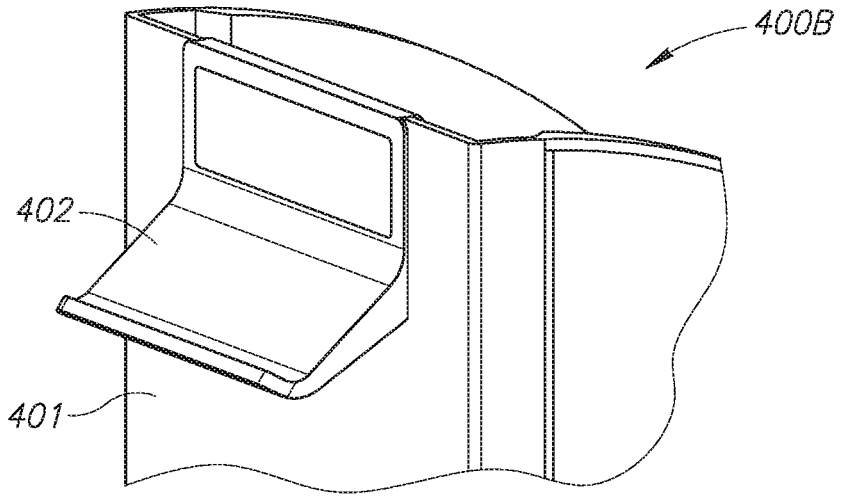
FIG. 10A is a front perspective view of a second embodiment of an assembled tilt bin in accordance with a second aspect of the present invention.
Figure 10B:
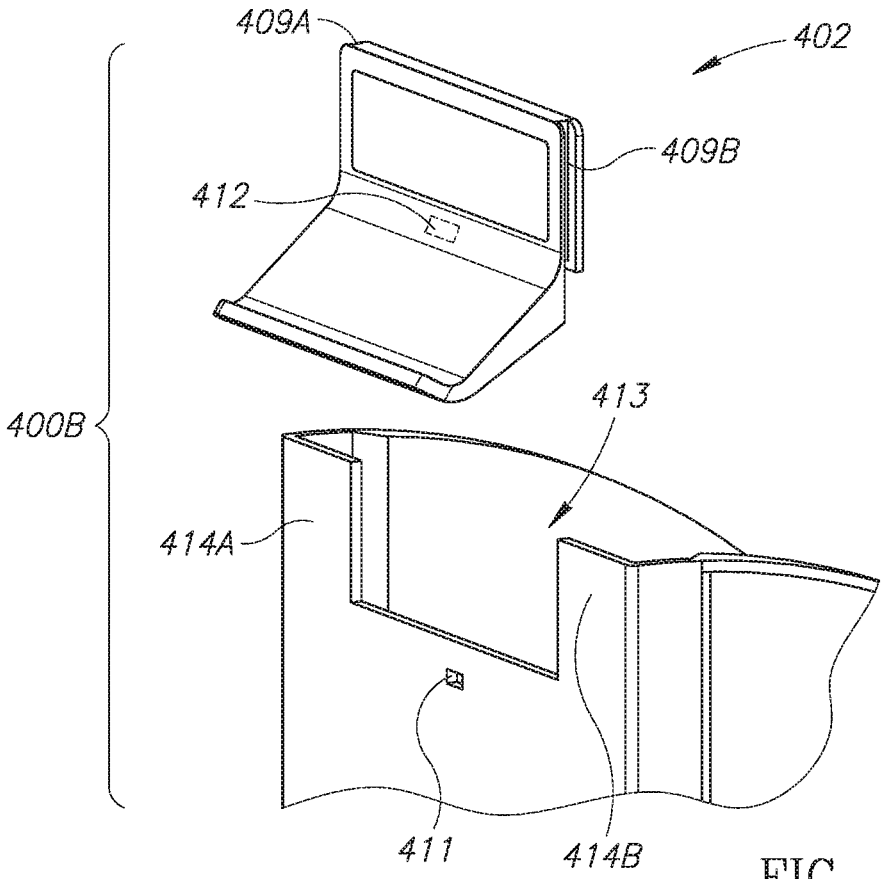
FIG. 10B is an exploded front perspective view of FIG. 10A's tilt bin.

FIG. 10A and FIG. 10B show an assembled tilt bin 400B similar in construction and operation as the assembled tilt bin 400A and therefore similar parts are likewise numbered. The tilt bin 400B differs from the tilt bin 400A insofar as its tilt bin shell front surface 401A is formed with a central cutout 413 and a lateral pair of major tilt bin shell front surface sections 414A and 414B. The discrete tilt bin handle 402 for use in the tilt bin 400B is narrower than the tilt bin 400A's discrete tilt bin handle 402 but is similarly formed with upright grooves 409A and 409B for sliding receiving the lateral pair of major tilt bin shell front surface sections 414A and 414B on downward sliding of the discrete tilt bin handle 402 on the tilt bin shell front surface 401A in the direction of the tilt bin shell bottom surface 401C. The tilt bin 400B includes a securing arrangement 403 constituted by a single central slot 411/protrusion 412 engagement.

Figure 11A:
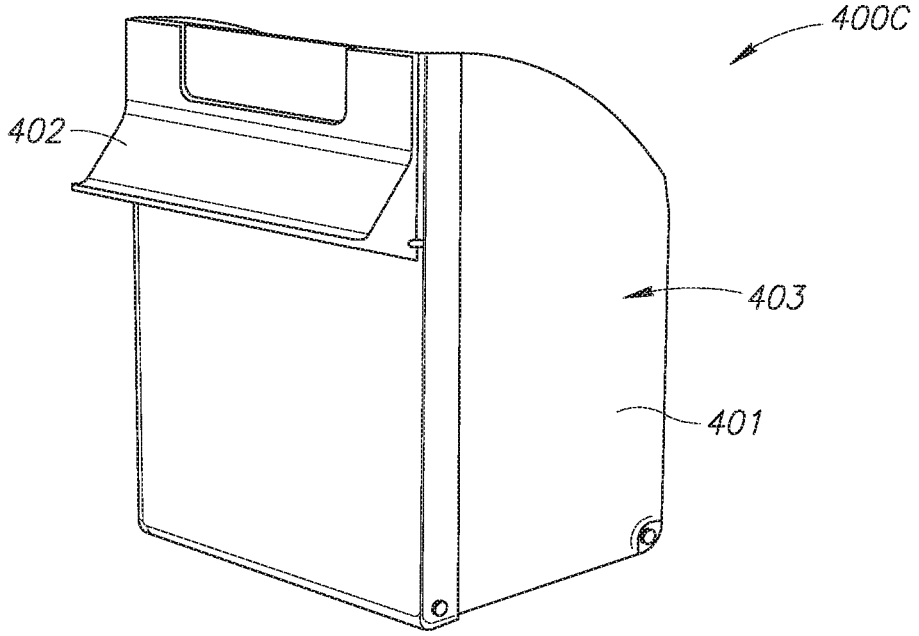
FIG. 11A is a front perspective view of a third embodiment of an assembled tilt bin in accordance with a second aspect of the present invention.
Figure 11B:
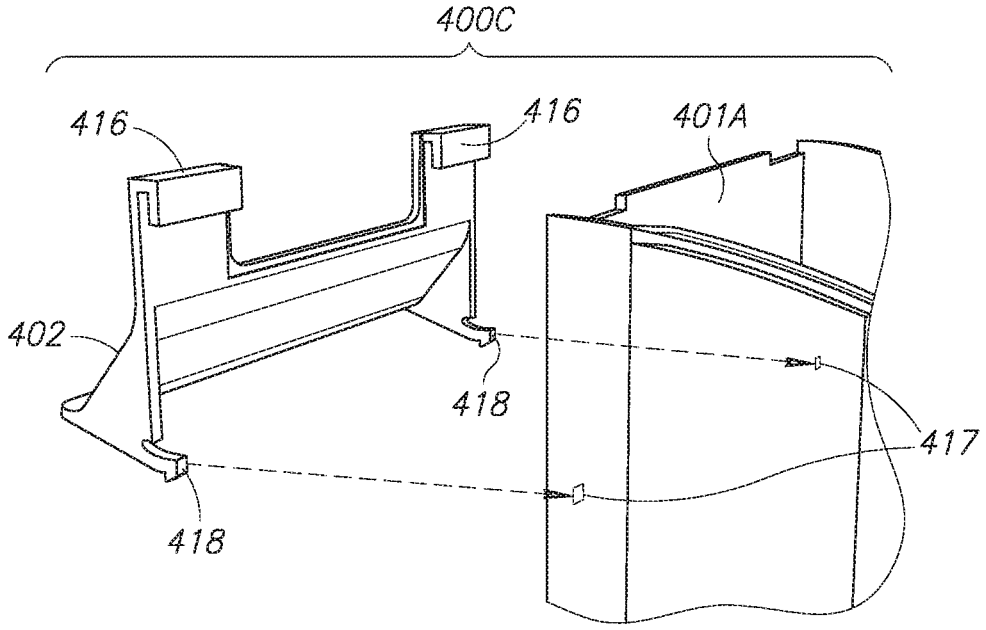
FIG. 11B is an exploded rear perspective view of FIG. 11A's tilt bin.

FIG. 11A and FIG. 11B show an assembled tilt bin 400C similar in construction and operation as the assembled tilt bin 400A and therefore similar parts are likewise numbered. The tilt bin 400C differs from the tilt bin 400A insofar the tilt bin 400C includes a discrete tilt bin handle 402 having a lateral pair of spaced apart clips 416 for downward sliding onto the tilt bin shell front surface 401A's top rim. The securing arrangement 403 is constituted by the tilt bin shell front surface 401A being formed with a lateral pair of spaced apart lateral slots 417 and the tilt bin left side surface 401D and the tilt bin right side surface 401E being formed with a corresponding pair of protrusions 418 for snap fit thereinto.

While the invention has been described with respect to a limited number of embodiments, it will be appreciated that many variations, modifications, and other applications of the invention can be made within the scope of the appended claims.

The invention claimed is:

1. A tilt bin for use in a tilt bin storage system having at least one tilt bin compartment, the tilt bin comprising:

(a) an open-topped generally cuboid shaped tilt bin shell having:

a tilt bin shell front surface, a tilt bin shell back surface, a tilt bin shell bottom surface, a tilt bin shell left side surface, and a tilt bin shell right side surface, wherein said tilt bin shell left side surface and said tilt bin shell right side surface each have a leading outward directed sideway protrusion towards said tilt bin shell front surface and a trailing outward directed sideway stopper towards said tilt bin shell back surface for engaging complementary features located on opposite sides in a tilt bin compartment of the tilt bin storage system's at least one tilt bin compartment, wherein said tilt bin shell front surface has a spaced apart upright pair of a left side slit and a right side slit correspondingly adjacent said tilt bin shell left side surface and said tilt bin shell right side surface, said left side slit and said right side slit bound a central major tilt bin shell front surface section in said tilt bin shell front surface section;

said left side slit and said right side slit bound a lateral pair of minor tilt bin shell front surface sections correspondingly located adjacent said tilt bin shell left side surface and said tilt bin shell right side surface;

(b) a discrete tilt bin handle that includes:

a tilt bin handle front surface, a tilt bin handle back surface, a tilt bin handle left side surface, and a tilt bin handle right side surface, said tilt bin handle left side surface and said tilt bin handle right side surface each include an upright groove, wherein said discrete tilt bin handle can engage said tilt bin shell front surface upon the downward sliding of said discrete tilt bin handle into said left side slit and said right side slit, said tilt bin handle left side surface and said tilt bin handle right side surface are slidingly received by said lateral pair of minor tilt bin shell front surface sections in their corresponding upright grooves, said tilt bin handle front surface having a downwardly directed grip section co-extensive with said tilt bin shell front surface and forwardly protruding therefrom for enabling a manual tilting of the tilt bin in a tilt bin compartment between an upright closed position and a tilted forward open position; and (c) a securing arrangement for securing said discrete tilt bin handle on said open-topped generally cuboid shaped tilt bin shell on said downward sliding of said discrete tilt bin handle on said tilt bin shell front surface, said securing arrangement comprising at least one slot located in said central major tilt bin shell front surface section, and at least one corresponding protrusion on said tilt bin handle back surface such that said at least one protrusion can snap fit into said at least one slot.

2. A method for making a tilt bin for use in a tilt bin storage system having at least one tilt bin compartment, the method comprising:

(a) providing a tilt bin shell having:

a tilt bin shell front surface, a tilt bin shell back surface, a tilt bin shell bottom surface, a tilt bin shell left side surface, and a tilt bin shell right side surface;

providing a first leading protrusion on said tilt bin shell left side surface and a second leading protrusion on said tilt bin shell right side surface, said protrusions are outwardly directed sideways towards said tilt bin shell front surface, and providing a first trailing stopper on said tilt bin shell left side surface and a second trailing stopper on said tilt bin shell right side surface, said stoppers are outwardly directed sideways towards said tilt bin shell front surface, wherein said protrusions and stoppers are for engaging complementary features located on opposite sides in the tilt bin compartment of said tilt bin storage system's tilt bin compartment;

wherein said tilt bin shell front surface has a spaced apart upright pair of a left side slit and a right side slit correspondingly adjacent said tilt bin shell left side surface and said tilt bin shell right side surface, said left side slit and said right side slit bound a central major tilt bin shell front surface section in said tilt bin shell front surface section, and said left side slit and said right side slit bound a lateral pair of minor tilt bin shell front surface sections correspondingly joined with said tilt bin shell left side surface and said tilt bin shell right side surface, providing a lateral pair of spaced apart slots located in said central major tilt bin shell front surface section, and a corresponding lateral pair of spaced apart protrusions on said tilt bin handle back surface, (b) providing a discrete tilt bin handle that includes:

a tilt bin handle front surface, a tilt bin handle back surface, a tilt bin handle left side surface, and a tilt bin handle right side surface, wherein said tilt bin handle front surface has a downwardly directed grip section co-extensive with said tilt bin shell front surface and forwardly protruding therefrom for enabling a manual tilting of the tilt bin in a tilt bin compartment between an upright closed position and a tilted forward open position when attached to said tilt bin shell, providing an upright groove on each said tilt bin handle left side surface and said tilt bin handle right side surface, and providing a lateral pair of spaced apart protrusions on said tilt bin handle back surface;

(c) downwardly sliding said tilt bin handle such that said tilt bin handle left side surface and said tilt bin handle right side surface correspondingly slide into said left side slit and said right side slit, and such that said tilt bin handle left side surface and said tilt bin handle right side surface slidingly receive said lateral pair of minor tilt bin shell front surface sections in their corresponding upright grooves, and (d) snapping said lateral pair of spaced apart protrusions on said tilt bin handle back surface into said spaced apart slots located in said central major tilt bin shell front surface section to provide a securing arrangement for securing said discrete tilt bin handle on said tilt bin shell.

* * * * *